US008533997B2

(12) United States Patent
Stoutenborough et al.

(10) Patent No.: US 8,533,997 B2
(45) Date of Patent: Sep. 17, 2013

(54) OPERATING ASSEMBLY FOR A LIFTING AND SLIDING FENESTRATION ASSEMBLY AND RELATED METHODS

(75) Inventors: Eric Stoutenborough, Fort Atkinson, WI (US); Kyle Koch, Warroad, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 582 days.

(21) Appl. No.: 12/496,455

(22) Filed: Jul. 1, 2009

(65) Prior Publication Data

US 2011/0000138 A1 Jan. 6, 2011

(51) Int. Cl.
*E05D 15/12* (2006.01)

(52) U.S. Cl.
USPC ..... 49/235; 49/208; 49/226; 49/234; 49/425; 49/460; 292/336.3

(58) Field of Classification Search
USPC ..... 49/208, 226, 234, 235, 404, 425, 49/125–130, 460; 52/204.51, 207, 64; 160/40, 160/43, 196.1; 292/336.3, DIG. 46, DIG. 20, 292/DIG. 47
See application file for complete search history.

(56) References Cited

U.S. PATENT DOCUMENTS 967,377 A * 8/1910 Henry ..... 292/142
1,488,827 A * 4/1924 Pape ..... 49/127
3,226,778 A * 1/1966 Kollsman et al. ..... 49/130
3,387,876 A 6/1968 Lyons, Jr.
3,879,893 A 4/1975 Helmick
4,674,777 A * 6/1987 Guelck ..... 292/101
5,012,611 A * 5/1991 Hsu ..... 49/225
5,087,087 A * 2/1992 Vetter et al. ..... 292/48
5,598,664 A * 2/1997 Grice ..... 49/74.1
5,659,999 A 8/1997 Benson
5,741,031 A * 4/1998 Bauman et al. ..... 292/139
5,813,710 A * 9/1998 Anderson ..... 292/336.3
5,845,363 A 12/1998 Brempell et al.
5,860,189 A 1/1999 An
6,135,511 A * 10/2000 Smith et al. ..... 292/156
7,322,619 B2 1/2008 Nolte et al.
7,377,076 B2 5/2008 Shedd
7,735,347 B2 6/2010 Tsuchikiri et al.
7,788,851 B2 9/2010 Curtis et al.

(Continued)

OTHER PUBLICATIONS

"Hoppe Lift and Slide Hauau", product brochure, (Sep. 9, 2010), 16 pgs.
"Lift-Slide Hardware for Wood Windows and Doors", product brochure, (2007), 17 pgs.

(Continued)

*Primary Examiner* — Katherine Mitchell
*Assistant Examiner* — Marcus Menezes
(74) *Attorney, Agent, or Firm* — Schwegman Lundberg & Woessner, P.A.

(57) ABSTRACT

A lift and sliding fenestration assembly includes a single or multi lift/slide panel assembly including at least a primary panel and an optional secondary panel, where the primary panel is slidable along a first plane. The fenestration assembly further includes a linkage system operatively coupled with the lift/slide panel assembly, and a handle is coupled with the linkage system. The handle has an open position and a closed position, and the handle is movable between an open position and a closed position. The handle travels in a second plane, and the second plane is transverse to the first plane. In a further option, the primary panel is slidable along the first plane when the handle is rotated and placed in an open position.

12 Claims, 6 Drawing Sheets

(56) References Cited

U.S. PATENT DOCUMENTS

| | | | | |
|---|---|---|---|---|
| 7,963,577 | B2 | 6/2011 | Wolf | |
| 7,971,392 | B2 | 7/2011 | Seo | |
| 8,240,089 | B2 | 8/2012 | Lambertini | |
| 2004/0163317 | A1* | 8/2004 | Reich et al. | 49/209 |
| 2006/0185408 | A1* | 8/2006 | Graham et al. | 70/208 |
| 2008/0178530 | A1 | 7/2008 | Ellerton et al. | |
| 2013/0042534 | A1 | 2/2013 | Polus | |

OTHER PUBLICATIONS

"U.S. Appl. No. 13/302,550, Non Final Office Action mailed Apr. 12, 2013", 19 pgs.
"U.S. Appl. No. 13/302,550, Response filed Feb. 15, 2013 to Restriction Requirement mailed Jan. 17, 2013", 7 pgs.
"U.S. Appl. No. 13/302,550, Restriction Requirement mailed Jan. 17, 2013", 6 pgs.

* cited by examiner

OPERATING ASSEMBLY FOR A LIFTING AND SLIDING FENESTRATION ASSEMBLY AND RELATED METHODS

TECHNICAL FIELD

The present disclosure relates to a lifting and sliding fenestration assembly and related methods.

TECHNICAL BACKGROUND

Lift and slide doors and windows can provide large slidable panels, allowing for large doors or windows which do not obscure the view when opened and/or closed. During use of the doors or windows, the door or window is lifted and slid to the side, and possibly in a pocket so that the door or window is no longer in view and building occupants can access the exterior via the opening. The doors or windows also provide a barrier against weather including wind and rain. The doors or windows must be able to withstand a certain amount of pressure from weather including wind, yet remain operable and openable for users. For instance, the doors or windows need to seal and exclude the weather elements, yet the doors or windows need to be able to slide open.

SUMMARY

A lift and sliding fenestration assembly includes a panel assembly including at least a primary panel and optionally a secondary panel, where the primary panel is slidable along a first plane. In an option, a third panel is included and slidable along the first plane. The fenestration assembly further includes a linkage system operatively coupled with the lift/slide panel assembly, and a handle is coupled with the linkage system. The handle has an open position and a closed position, and the handle is movable between an open position and a closed position. The handle travels in a second plane, and the second plane is transverse to the first plane. In a further option, the primary panel is slidable along the first plane when the handle is rotated and placed in an open position. The handle and/or linkage system can be mounted, such as a flush mount, on any of the panels of the fenestration assembly, or each of the panels of the fenestration assembly. In yet another option, the handle and/or linkage system can be mounted, such as a flush mount, on each of the panels except for a stationary panel.

Several options for the fenestration assembly are as follows. For instance, in an option, the primary panel is defined in part by a corner edge portion, and the handle is disposed along the corner edge portion. In a further option, the handle is disposed within a recess when the handle is in a closed position and/or an open position. Additional options include the linkage system having a drive rail movable along a first axis, the drive rail including one or more guide tracks therein, and/or one or more pins received by the one or more guide tracks, and/or a substantially planar C-shaped link. In a further option, the drive rail is coupled with a stile of the primary panel, and/or the handle includes a securing detent.

A lift and sliding fenestration assembly includes a multi lift/slide panel assembly including at least a primary panel and a secondary panel, and optionally a third tertiary panel, where the primary panel is slidable along a first plane. The fenestration assembly further includes a linkage system operatively coupled with the lift/slide panel assembly, where the linkage system includes a drive rail coupled with a stile of the primary panel, and further including a back cover and a front cover. The fenestration assembly further includes a flush mount handle coupled with the linkage system, the handle is movable between an open position and a closed position, and travels in a second plane, which is transverse to the first plane. The primary panel is slidable along the first plane when the handle is rotated and placed in an open position.

Several options are as follows. For instance, in an option, the handle includes a securing detent. In a further option, the primary panel is defined by a corner edge portion, the handle is disposed on the corner edge portion.

A method includes rotating a handle from a first closed position to a second open position, where rotating the handle occurs within a first plane, and the handle is coupled with a linkage system. The method further includes translating the drive rail and primary panel within a second plane, lifting at least the primary panel from a closed position to an operational position; and sliding the primary panel along a track within the second plane, the second plane is substantially transverse to the first plane.

Several options for the methods are as follows. For instance, in an option, the method further includes rotating the handle toward a first direction and lifting the primary panel toward a second direction, where the first direction is opposite of the second direction, and/or disposing the handle in a recess and flush mounting the handle. In a further option, the method includes sliding a secondary panel after at least partially sliding the primary panel, and/or sliding a tertiary panel after at least partially sliding the primary panel and the secondary panel. In yet another option, the method includes securing the handle, for instance, securing the handle includes engaging a handle detent and a projection.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

BRIEF DESCRIPTION OF THE DRAWINGS

In the drawings, like numerals describe substantially similar components throughout the several views Like numerals having different letter suffixes represent different instances of similar components. The drawings illustrate generally, by way of example, but not by way of limitation, various embodiments discussed in the present document.

DESCRIPTION OF THE EMBODIMENTS

The following detailed description includes references to the accompanying drawings, which form a part of the detailed description. The drawings show, by way of illustration, specific embodiments in which the present fenestration assemblies and methods may be practiced. These embodiments, which are also referred to herein as "examples," are described in enough detail to enable those skilled in the art to practice the present fenestration assemblies and methods. The embodiments may be combined, other embodiments may be utilized or structural or logical changes may be made without departing from the scope of the present fenestration assemblies and methods. The following detailed description is, therefore, not to be taken in a limiting sense, and the scope of the present fenestration assemblies and methods is defined by the appended claims and their legal equivalents.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation.

Figure 1:
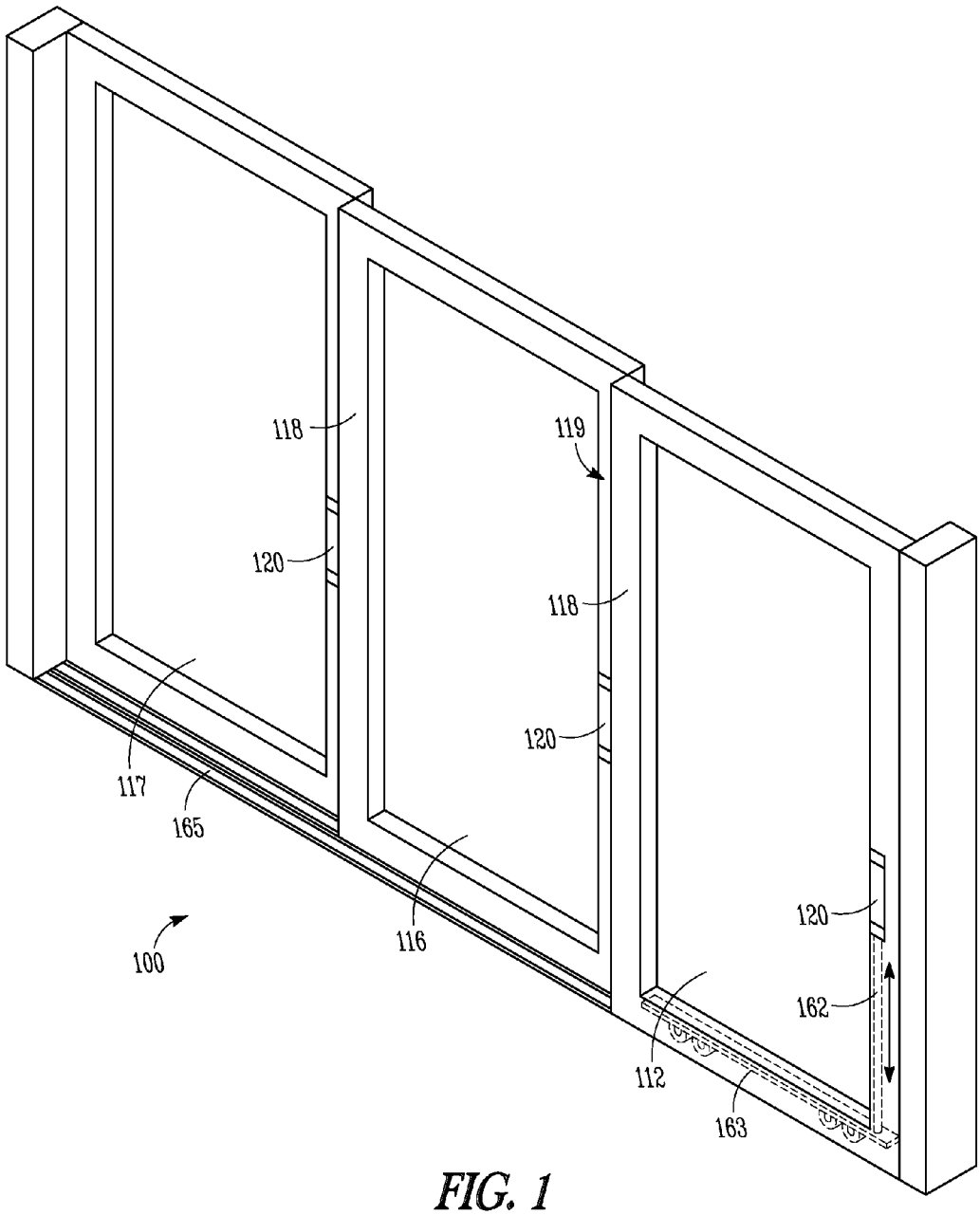
FIG. 1 is a perspective view of a lift and sliding fenestration assembly as constructed in accordance with at least one embodiment.

FIG. 1 illustrates an example of a lift and sliding fenestration assembly 100. The lift and sliding fenestration assembly 100 includes in an option a single panel assembly, with a primary panel 112. In another option, the lift and sliding fenestration assembly 100 includes multi lift/slide panel assembly 110 including at least a primary panel 112 and a secondary panel 116, and optionally a third, tertiary panel 117. The secondary panel 116 may be a slidable, operable panel. Alternatively, the secondary panel 116 may be a fixed, stationary panel. It should be noted that additional panels can be used as well. For example, four or more panels can be used. In another option, up to eight slidable panels can be used. In yet another option, the fenestration assembly 100 is a biparting assembly.

The primary panel 112, optional secondary panel 116, and/or the optional third, tertiary panel 117 are slidable along a first plane of movement, for example along a track and relative to an outer frame. The panels include a frame that surrounds one or more glass panes. For instance, the primary panel 112, secondary panel 116, and tertiary panel 117 are defined in part by one or more stiles 118. In a further option, the primary panel 112, the secondary panel 116, and the third tertiary panel 117 are defined in part by a corner edge portion 119. The corner edge portion 119 includes a portion of a side of the panel, for instance a side of the stile 118. The corner edge portion 119 further includes a portion of a front of the panel, for instance a front portion of the stile 118. The handle 120 is recessed within the corner edge portion 119 such that the handle 120 can be flush mounted on the panels 112, 116, 117.

Figure 2:
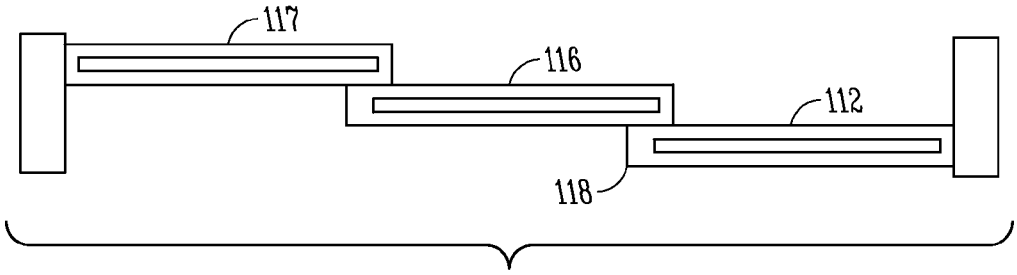
FIG. 2 is a top view of a portion of a lift and sliding fenestration assembly in a closed position as constructed in accordance with at least one embodiment.
Figure 3:
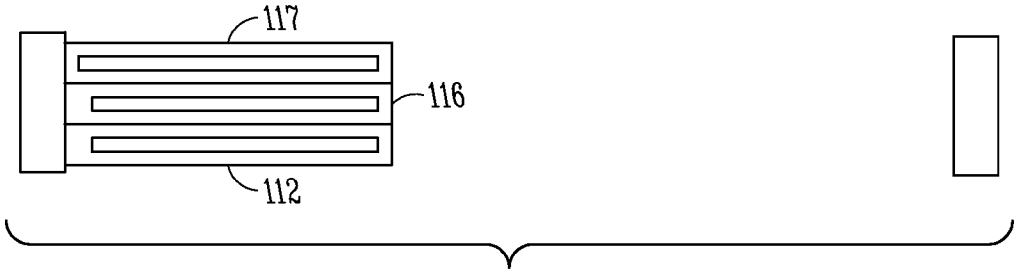
FIG. 3 is a top view of a portion of a lift and sliding fenestration assembly in an open position as constructed in accordance with at least one embodiment.
Figure 4:
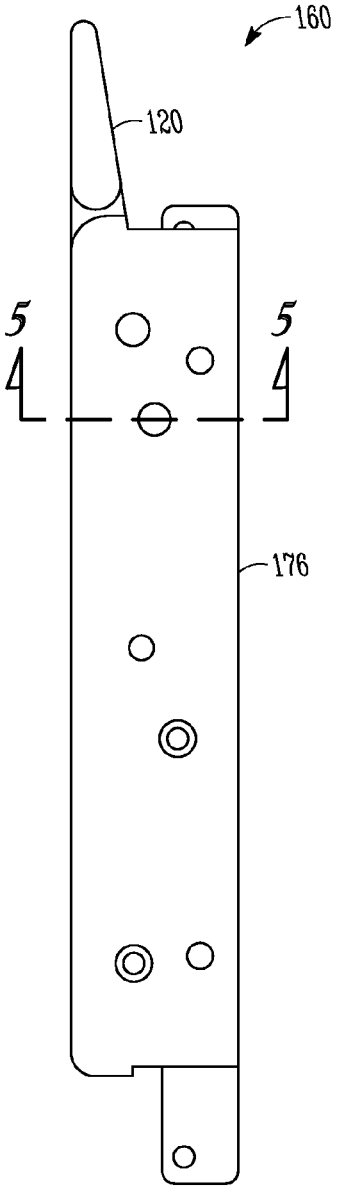
FIG. 4 is a side view of a linkage assembly as constructed in accordance with at least one embodiment.
Figure 6:
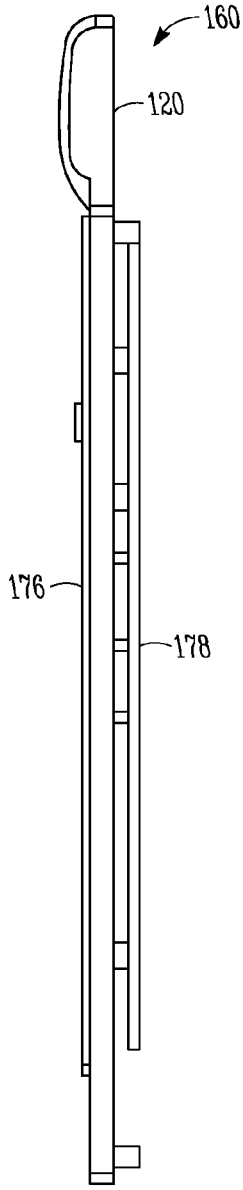
FIG. 6 is a side view of a linkage assembly as constructed in accordance with at least one embodiment.
Figure 5:
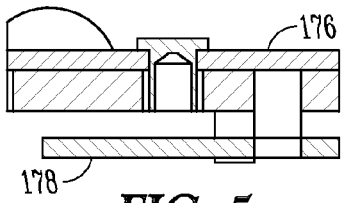
FIG. 5 is a cross-sectional view of a linkage assembly taken along 5-5 of FIG. 4 as constructed in accordance with at least one embodiment.
Figure 7:
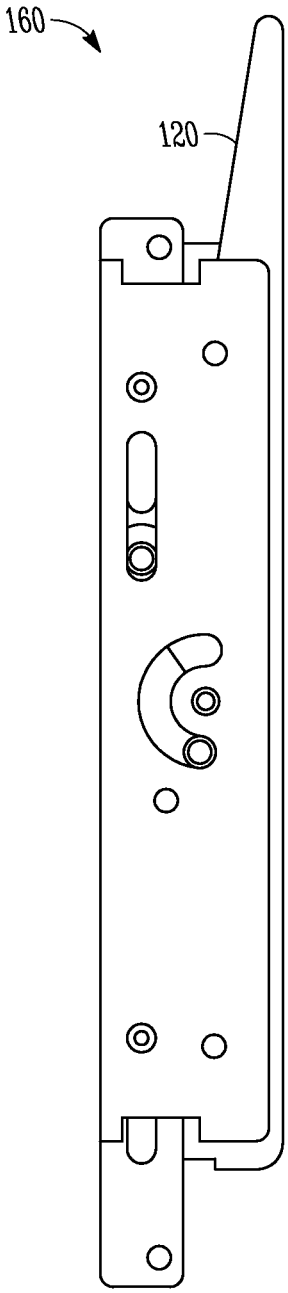
FIG. 7 is a side view of a linkage assembly as constructed in accordance with at least one embodiment.
Figure 8:
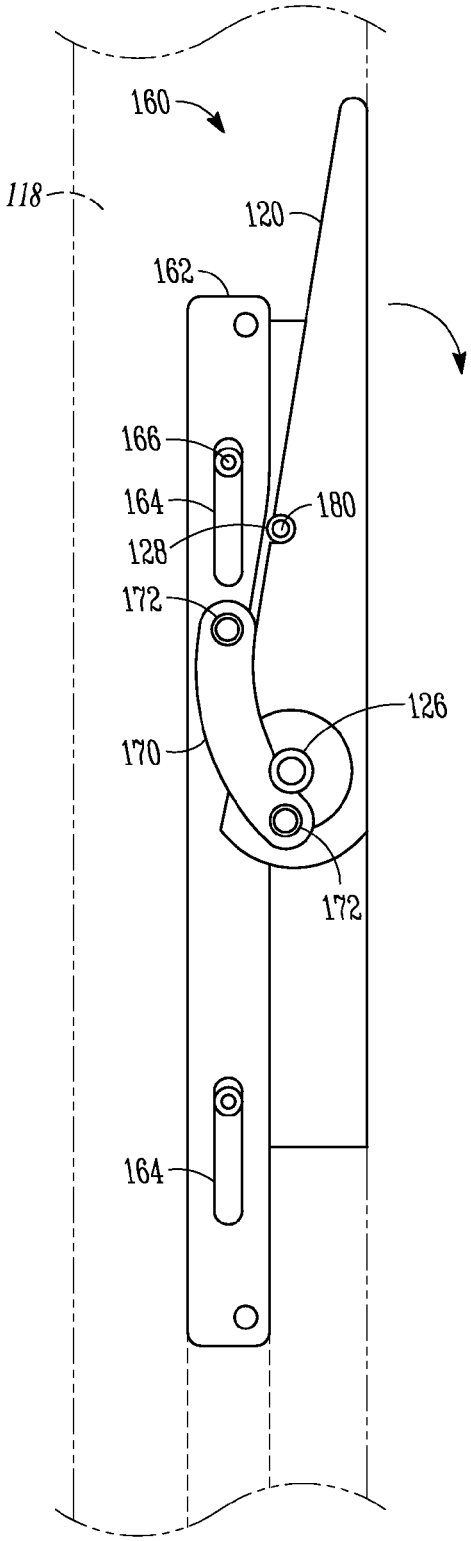
FIG. 8 is a side view of a linkage assembly as constructed in accordance with at least one embodiment.

In an option, the lift and sliding fenestration assembly 100 is suitable for doors, windows, or other fenestration assemblies. The lift and sliding fenestration assembly 100 operates such that the panels 112, 116, 117 slide and can slide at least a portion past one another such that the panels 112, 116, 117 can stack in front of one another, and thereby do not obstruct the view from within the building, and the handle assembly does not interfere with the ability to stack the panels 112, 116, 117. In another option, the panels 112, 116, 117 stack on top of one another such as the end is flush, due in part to the flush mount handle 120, as further discussed below. FIGS. 2 and 3 illustrate the panels 112, 116, 117 in a closed position (FIG. 2), and an open, stacked position (FIG. 3). In another option, the panels can be tucked in a pocket within the wall such that they are not visible.

Figure 9:
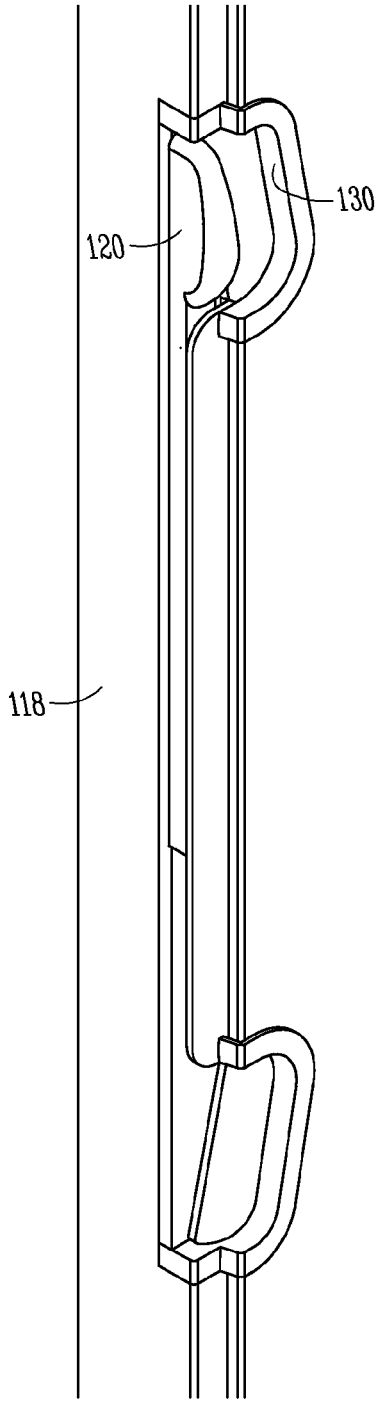
FIG. 9 is a perspective view of a portion of a lift and sliding fenestration assembly as constructed in accordance with at least one embodiment.
Figure 10:
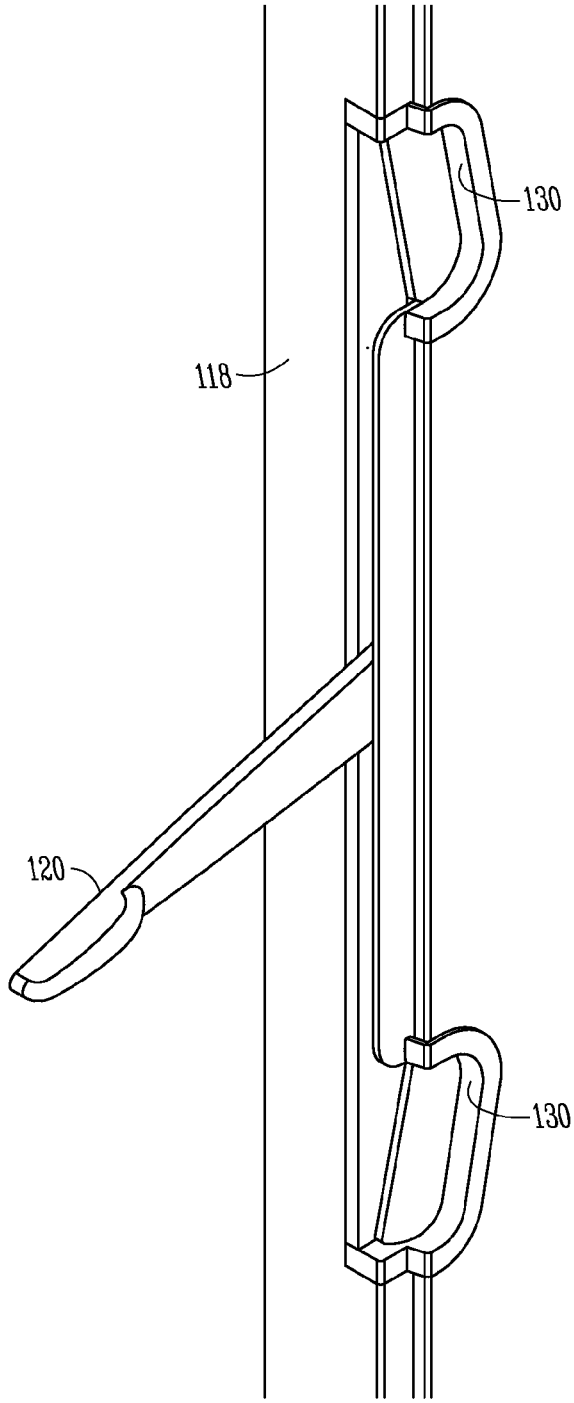
FIG. 10 is a perspective view of a portion of a lift and sliding fenestration assembly as constructed in accordance with at least one embodiment.

To operate the panels, the lift and sliding fenestration assembly 100 includes a handle 120, which has an open, operable position and a closed position and is rotatable between the open and closed position. In the closed position, the panels 112, 116, 117 cannot be readily slid. In a further option, the handle 120 in the closed position is in a locked or secured position. In the secured position, in an option, the weight of the panels 112, 116, 117 prevent the panels 112, 116, 117 from sliding relative to the outer frame. In another option, in addition or in alternative, the handle 120 locks the linkage system 160 and prevents it from operating. For instance, the handle 120 includes a securing detent that receives a projection therein, which prevents movement of the primary panel 112 and the handle 120. In an option, the handle 120, when moved from and to the open position from the closed position, travels within a second plane of movement. The second plane of movement is substantially transverse to the first plane of movement. Referring to FIGS. 9 and 10, in an option, the handle 120 is disposed up when placed in a closed position (FIG. 9), and is received within a recess 130, allowing for the handle 120 to be flush mounted against the primary panel 112. In a further option, the handle 120 is received within a second recess 130 when the handle 120 is placed in the open position.

The handle 120 is disposed along corner edge portion of the panels 112, 116, 117. The handle 120 and/or linkage system 160 can be mounted, such as a flush mount, on any of the panels 112, 116, 117 of the fenestration assembly, or each of the panels of the fenestration assembly. In yet another option, the handle 120 and/or linkage system 160 can be mounted, such as a flush mount, on each of the openable panels 112, 116, 117 except for a stationary panel. In yet another option, the fenestration assembly includes biparting panels, where two panels come together from opposite sides of a frame. The biparting doors or windows can include two or more panels, with a handle 120 mounted on the sliding panels. The flush mount handles allow for the panels to be stacked, for example, as shown in FIG. 3.

The handle 120 is operably coupled with a linkage system 160, which is operatively coupled with the lift/slide panel assembly 110 (e.g.,configured to lift and lower respective panels). In an option, the linkage system 160 is coupled with each of the panels 112, 116, 117, and in a further option the linkage system 160 is coupled with each movable panel. The linkage system 160 includes a drive rail 162 movable along a first axis relative to the panel 112, For instance the drive rail 162 is slidably received within a channel of the stile 118. The drive rail 162 further including one or more guide tracks 164 therein. The guide track 164 receives, in an option, one or more pins 166 therein, and the pins are fixed relative to the panel 112 (e.g., the drive rail 162 moves relative to panel 112 along the pins 166). The linkage system 160 further includes a substantially planar link, such as a C-shaped link 170. The linkage system 160 further includes a front cover 176 and a back cover 178.

The handle 120 is coupled with the linkage system 160 at a pivot point 126, the pivot point 126 and accordingly the handle 120 are static relative to the panel 112. Stated another way, while the handle 120 is rotated, the handle itself at the pivot point 126 does not raise or lower relative to the panel 112 (or 116 or 117 if associated with those panels). As the handle 120 is rotated a roller 172 is driven which in turn drives a C-shaped link 170. The link 170 is coupled with the roller 172 and the drive rail 162. The rotational movement of the handle 120 is used to drive the drive rail 162 in a linear, vertical movement, for instance upward relative to the panel 112. The drive rail 162, which is coupled with the stile 118 of the primary panel 112 (e.g., slidably coupled within a channel in the stile 118) lifts or lowers the primary panel 112. When the primary panel 112 is lifted, the wheels, such as bogie wheels 163 (having a chassis or framework known with bogie wheels) coupled with the drive rail, allow for the panels, such as windows or doors, to be slid along the second plane.

A method includes rotating a handle 120 from a first closed position to a second open position, where rotating the handle 120 occurs within a first plane, and the handle 120 is coupled with a linkage system 160. The method further includes translating the drive rail 162 and primary panel 112 within a second plane, lifting at least the primary panel 112 from a closed position to an operational position; and sliding the primary panel 112 along a track within the second plane, the second plane is substantially transverse to the first plane.

Several options for the methods are as follows. For instance, in an option, the method further includes rotating the handle 120 toward a first direction and lifting the primary panel 112 toward a second direction, where the first direction is opposite of the second direction, and/or disposing the handle 120 in a recess and flush mounting the handle 120. In a further option, the method includes sliding a secondary panel 116 after at least partially sliding the primary panel 112, and/or sliding a tertiary panel after at least partially sliding the primary panel 112 and the secondary panel 116. In yet another option, the method includes securing the handle 120, for instance, securing the handle 120 includes engaging a handle detent 128 or a recess with a projection 180 of the linkage system 160.

It is to be understood that the above description is intended to be illustrative, and not restrictive. For instance, any of the aforementioned examples may be used individually or with any of the other examples. Many other embodiments may be apparent to those of skill in the art upon reviewing the above description. The scope of the present fenestration assemblies and methods should, therefore, be determined with reference to the appended claims, along with the full scope of legal equivalents to which such claims are entitled. In the appended claims, the terms "including" and "in which" are used as the plain-English equivalents of the respective terms "comprising" and "wherein." Also, in the following claims, the terms "including" and "comprising" are open-ended, that is, a system, assembly, article, or process that includes elements in addition to those listed after such a term in a claim are still deemed to fall within the scope of such claim.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, various features may be grouped together to streamline the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus the following claims are hereby incorporated into the Detailed Description, with each claim standing on its own as a separate embodiment.

What is claimed is:

1. A lift and sliding fenestration assembly comprising:
a panel assembly including at least a primary panel, the primary panel slidable along a first plane;
a linkage system operatively coupled with the panel assembly, the linkage system is movable relative to at least the primary panel, and the primary panel is movable between lowered and lifted configurations according to operation of the linkage system, the linkage system including:
a roller having an axis of rotation that is spaced from and orbits about a handle pivot axis;
a link coupled with the roller; and
a drive rail coupled with the link and slidably coupled with the primary panel;
a handle coupled with the primary panel, the handle coupled with the linkage system and rotatable about the handle pivot axis to operate the linkage system between the lowered configuration and the lifted configuration wherein the roller axis of rotation is positioned above the handle pivot axis in the lifted configuration, and the handle rotates in a second plane transverse to the first plane; and
the primary panel is slidable along the first plane according to operation of the linkage system when the handle is rotated and the primary panel is lifted.

2. The lift and sliding fenestration assembly as recited in claim 1, wherein the panel assembly is a multi lift and slide panel assembly.

3. The lift and sliding fenestration assembly as recited in claim 1, further comprising a second handle coupled with a secondary panel, where the secondary panel includes a second linkage system, and the second handle is operatively coupled with the second linkage system.

4. The lift and sliding fenestration assembly as recited in claim 1, wherein the primary panel is defined in part by a corner edge portion, and the handle is disposed on the corner edge portion.

5. The lift and sliding fenestration assembly as recited in claim 1, wherein the handle is disposed within a recess in the primary panel when the handle is in closed or open positions.

6. The lift and sliding fenestration assembly of claim 5, wherein the entirety of the handle is retained within the recess in the open and closed positions.

7. The lift and sliding fenestration assembly as recited in claim 1, wherein the drive rail is movable along a first axis, and the drive rail includes one or more guide tracks therein.

8. The lift and sliding fenestration assembly as recited in claim 7, wherein the linkage system further includes one or more pins received by the one or more guide tracks.

9. The lift and sliding fenestration assembly as recited in claim 1, further comprising a tertiary panel, the tertiary panel having a third handle.

10. The lift and sliding fenestration assembly as recited in claim 1, wherein the drive rail is coupled with a stile of the primary panel.

11. The lift and sliding fenestration assembly as recited in claim 1, wherein the handle includes a securing detent.

12. The lift and sliding fenestration assembly of claim 1 comprising the handle coupled along a face of the primary panel and coupled with the linkage system, the handle travels entirely in the second plane between the open position and the closed position, and the entirety of the handle is flush to the face of the primary panel in the open and closed positions.

* * * * *